US005996696A

United States Patent [19]

Jeffree et al.

[11] Patent Number: 5,996,696

[45] Date of Patent: Dec. 7, 1999

[54] METHOD AND APPARATUS FOR TESTING THE INTEGRITY OF OIL DELIVERY TUBING WITHIN AN OIL WELL CASING

[75] Inventors: Raymond Stanley Jeffree, Sao Paulo, Brazil; Eduardo Sacco Ambrosoni, Caracas, Venezuela

[73] Assignee: Fike Corporation, Blue Springs, Mo.

[21] Appl. No.: 08/957,216

[22] Filed: Oct. 24, 1997

Related U.S. Application Data

[60] Provisional application No. 60/051,027, Jun. 27, 1997.

[51] Int. Cl.[6] ..... E21B 33/12

[52] U.S. Cl. ..... 166/386; 166/387; 166/374; 166/317

[58] Field of Search ..... 166/250.08, 317, 166/319, 373, 374, 386, 387

[56] References Cited

U.S. PATENT DOCUMENTS

| | | | |
|---|---|---|---|
| 244,042 | 7/1881 | Farrar . | |
| 1,569,293 | 1/1926 | Miller . | |
| 2,043,225 | 6/1936 | Armentrout et al. . | |
| 2,855,049 | 10/1958 | Zandmer . | |
| 3,062,292 | 11/1962 | Lowry et al. . | |
| 3,091,293 | 5/1963 | Fry . | |
| 3,095,040 | 6/1963 | Bramlett . | |
| 3,115,186 | 12/1963 | Kline . | |
| 3,166,124 | 1/1965 | Johnson . | |
| 3,211,229 | 10/1965 | Bramlett . | |
| 3,599,713 | 8/1971 | Jenkins . | |
| 3,662,834 | 5/1972 | Young . | |
| 3,980,134 | 9/1976 | Amancharla . | |
| 4,031,960 | 6/1977 | Dudley . | |
| 4,040,485 | 8/1977 | Vann et al. . | |
| 4,237,980 | 12/1980 | Robinson . | |
| 4,250,960 | 2/1981 | Chammas | 166/319 X |
| 4,281,715 | 8/1981 | Farley . | |
| 4,314,608 | 2/1982 | Richardson . | |
| 4,374,543 | 2/1983 | Richardson . | |
| 4,609,005 | 9/1986 | Upchurch . | |
| 4,691,775 | 9/1987 | Lustig . | |
| 4,694,903 | 9/1987 | Ringgenberg . | |
| 4,784,226 | 11/1988 | Wyatt . | |
| 4,846,272 | 7/1989 | Leggett . | |
| 4,907,655 | 3/1990 | Hromas et al. . | |
| 4,911,242 | 3/1990 | Hromas et al. . | |
| 5,044,444 | 9/1991 | Coronado | 166/387 |
| 5,271,465 | 12/1993 | Schmidt et al. . | |
| 5,318,126 | 6/1994 | Edwards et al. . | |
| 5,511,617 | 4/1996 | Snider . | |

*Primary Examiner*—Roger Schoeppel

*Attorney, Agent, or Firm*—Hovey, Williams, Timmons & Collins

[57] ABSTRACT

An apparatus and method for testing the integrity of oil delivery tubing within an oil well casing includes a rupture disc holder coupled with the tubing near the lower end thereof. As successive lengths of tubing are added, the assembled tubing is subjected to a test pressure with the pressure maintained by the presence of the rupture disc within the holder. When the tubing assembly is complete, it is subjected to a higher burst pressure sufficient to rupture the disc. This opens a passage through the holder for installation of the push-pull rod and for passage of oil from the pump, which is coupled with the tubing below the level of the holder.

14 Claims, 2 Drawing Sheets

METHOD AND APPARATUS FOR TESTING THE INTEGRITY OF OIL DELIVERY TUBING WITHIN AN OIL WELL CASING

RELATED APPLICATIONS

This application claims priority of provisional patent application Ser. No. 60/051,027, filed Jun. 27, 1997.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to the field of oil wells. In particular, the invention is concerned with an apparatus and method for testing the integrity of oil delivery tubing within an oil well casing including a rupture disc holder coupled with the tubing near the lower end thereof.

2. Description of the Prior Art

In order to place an oil well in service, a pump is coupled with a length of oil delivery tubing and lowered into the casing. Successive lengths of tubing forming a pipe string are threadably coupled until the pump is at depth. This can include thousands of feet of oil well tubing. A push-pull rod is then extended through the tubing and connected to the pump.

Leaks in the joints between tubing sections may have significant impact on pumping efficiency and oil well production. However, the removal of the pipe string and correction of the leaks represents substantial expense. Thus, the prior art points out the need for an effective technique to test oil well delivery tubing for integrity.

SUMMARY OF THE INVENTION

The present invention solves the prior art problems discussed above and provides a distinct advance in the state of the art. More particularly, the apparatus and method hereof enable the effective and economical testing of oil delivery tubing during assembly.

The preferred apparatus includes a tubular holder having a passage therethrough and a rupture disc positioned in closing relationship with the passage. The disc is configured to withstand a pressure at a first test pressure and to rupture and thereby open when subjected to a second burst pressure substantially higher than the first test pressure. In preferred forms, the test pressure is about 500 psi and the burst pressure is about 2000 psi.

In the preferred method, the holder with the rupture disc installed therein is connected to a section of oil delivery tubing to be lowered into an oil well casing. When a multi-segmented section of oil delivery tubing has been lowered into the casing a predetermined depth, liquid is introduced into the tubing and subjected to the test pressure in order to determine. The rupture disc prevents escape of the test liquid, typically water, from the lower end of the tubing during testing. Additional tubing segments are then added and the entire pipe string again subjected to the test pressure. If a leak is detected, it is known that the source of the leak is limited to those segments installed after the last test and only those segments need be checked.

When the desired number of segments have been assembled and the tubing is ready for service, the tubing is subjected to a burst pressure sufficient to burst the rupture disc and thereby open the holder passage. The push-pull rod can then be installed through the passage to the oil pump and oil pumping can proceed in a conventional manner.

DETAILED DESCRIPTION OF THE PREFERRED EMBODIMENT

Figure 1:
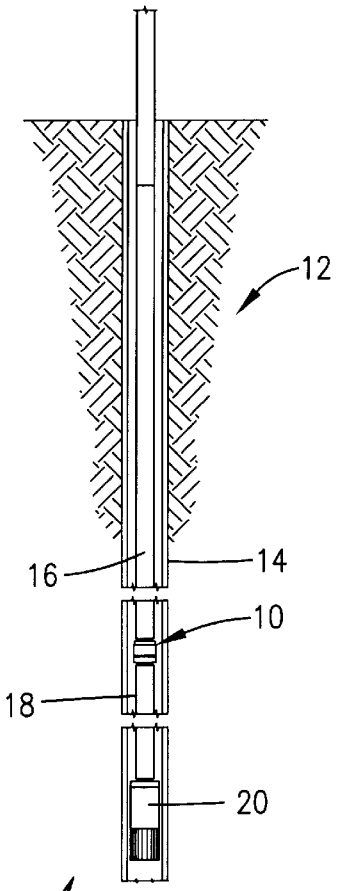
FIG. 1 is a fragmentary view in partial section of an oil well illustrating the preferred oil delivery tubing integrity testing apparatus in accordance with the present invention shown connected to oil delivery tubing.
Figure 2:
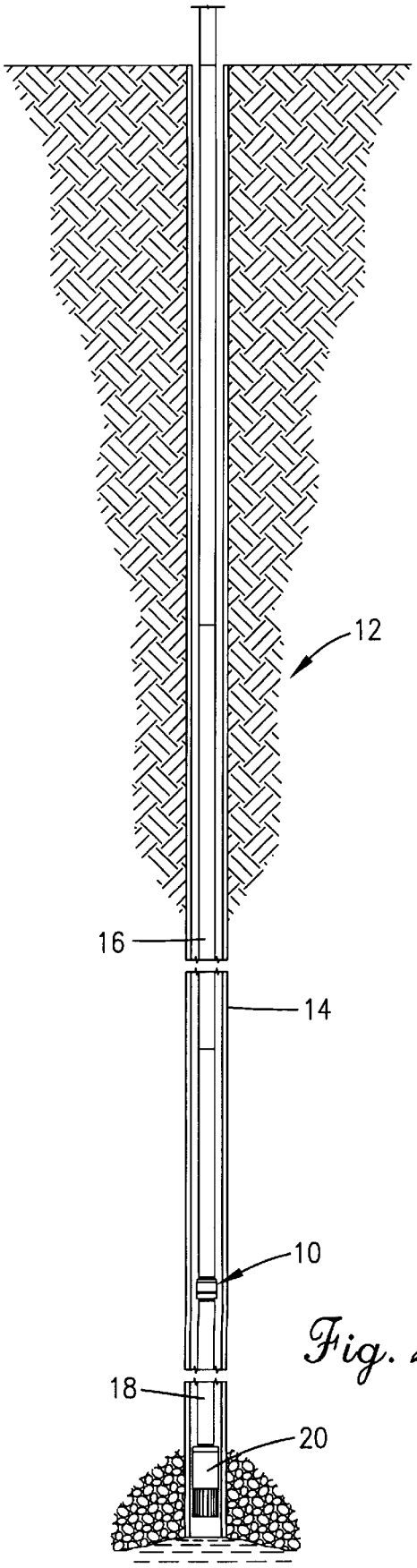
FIG. 2 is a view similar to FIG. 1 additionally showing the oil well pump at a depth for pumping.
Figure 3:
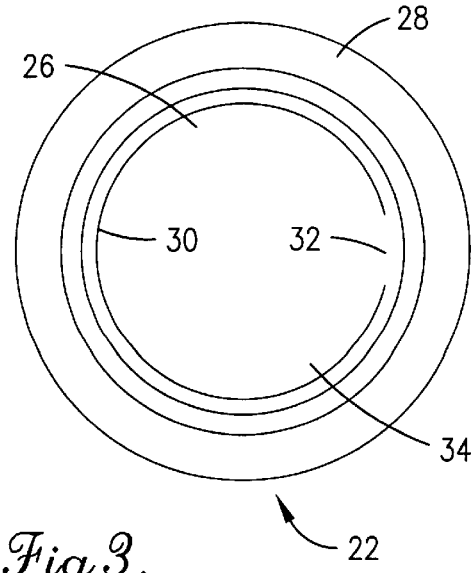
FIG. 3 is a top plan view of the preferred rupture disc positioned within the holder of FIG. 1.

FIGS. 1 and 2 illustrate preferred oil delivery tubing integrity testing apparatus 10 in accordance with the present invention shown in use as part of an oil well 12. Oil well 12 is conventional in nature and includes casing 14, multi-segmented upper section 16 of oil delivery tubing (also known as a pipe string), multi-segmented lower section 18 and oil pump 20.

Figures 4, 5, 6:
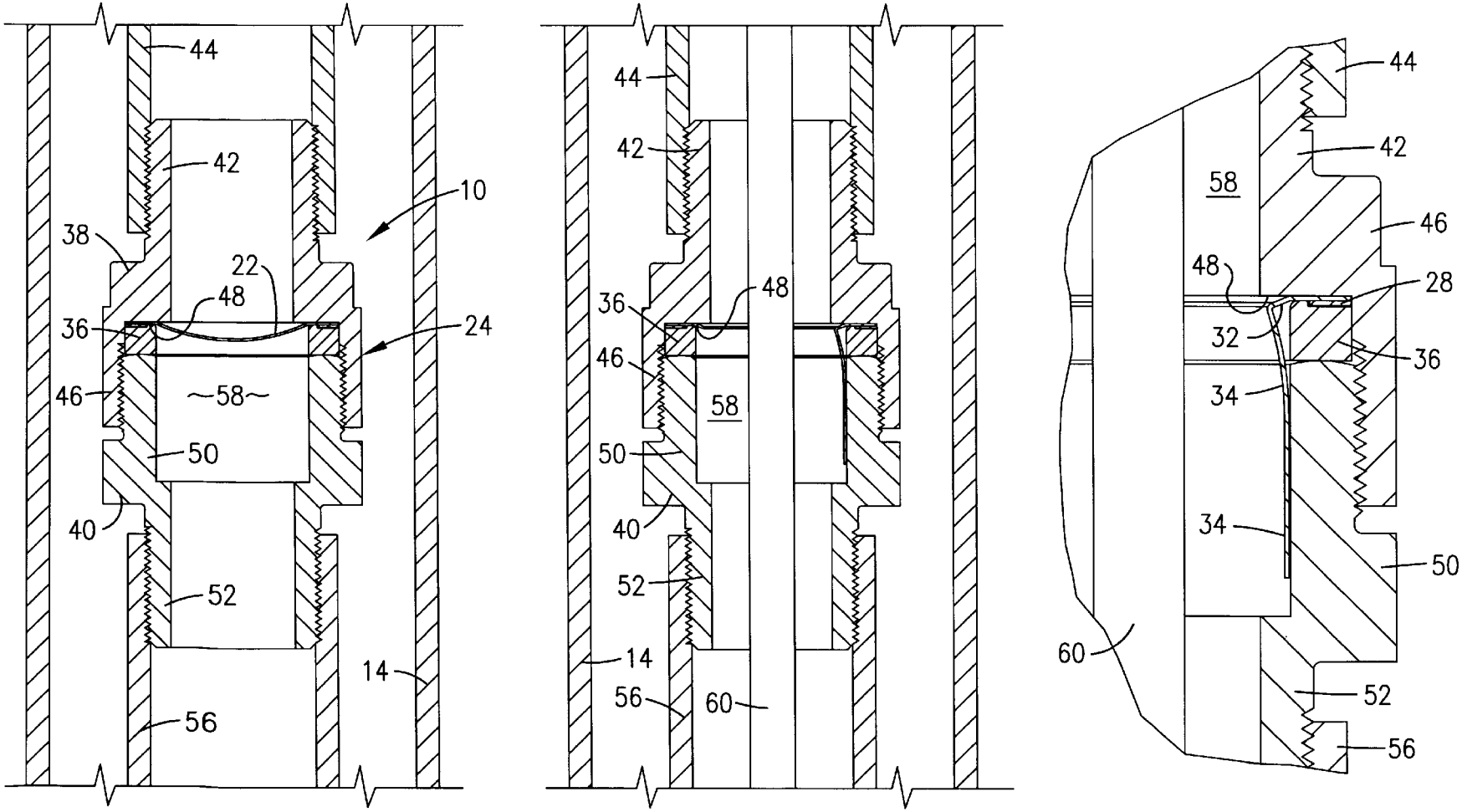
FIG. 4 is a sectional view of a portion of the oil well of FIG. 1 illustrating preferred rupture disc holder with the rupture disc intact.
FIG. 5 is a view similar to FIG. 4 but showing the rupture disc in the ruptured condition.
FIG. 6 is a partial sectional view of the holder of FIG. 5.

As illustrated in FIGS. 4, 5 and 6, preferred apparatus 10 includes rupture disc 22 and holder 24. Disc 22 is preferably composed of nickel 200 and includes bulge portion 26 and surrounding flange 28. Bulge portion 26 presents a concavo-convex configuration with score line 30 defined on the convex side thereof. Score line 30 generally defines a circular shape except for a gap therein defining hinge area 32. Score line 30 circumscribes rupture segment 34 and is precisely scored so that disc 22 will rupture, that is, separate at score line 30, at a burst pressure of about 2000 psi applied to the concave side thereof. When this occurs, segment 34 rotates about hinge area 32 as illustrated in FIGS. 5 and 6. When properly installed in holder 24, for example, rupture disc 22 will not burst at a test pressure of about 500 psi which is below the burst pressure of about 2000 psi.

Rupture disc 22 also includes mounting ring 36, rectangular in cross section, and welded to flange 28 on the convex side of disc 22. Ring 36 presents about the same internal and external diameters as rupture disc 22, and the internal diameters of these two components are the same as the internal diameter of the preferred oil delivery tubing. Ring 36 ensures secure mounting of disc 22 within holder 24.

Holder 24 includes upper member 38 and lower member 40. As illustrated in FIGS. 4–6, upper member 38 presents a generally tubular configuration and includes externally threaded coupling section 42 sized for threadably coupling with the internal threads of an adjacent length or segment 44 of oil delivery tubing. Upper member 38 further includes tubular, rupture disc mounting section 46 integral with coupling section 42 but presenting a greater inside diameter and a greater outside diameter. Mounting section 46 is internally threaded for threadably coupling with the external threads of lower member 40. The transition between coupling section 42 and mounting section 46 presents shoulder 48 which engages and supports rupture disc flange 28.

Lower member 40 integrally includes upper portion 50 and lower portion 52. Upper portion 50 is externally threaded for threadably coupling with coupling section 42 of upper member 38 and presents end face 54. Also, upper portion 50 presents the same internal and external diameters as rupture disc flange 28 and mounting ring 36. With this configuration, end face 54 engages mounting ring 36 and compresses ring 36 and rupture disc flange 28 against shoulder 48. This securely mounts rupture disc 22 within holder 24. Lower portion 52 is externally threaded for threadably coupling with the internal threads of adjacent oil delivery segment 56.

To install testing apparatus 10 in oil well 12, oil well pump 20 is connected to lower section 18 of oil delivery tubing and lowered into oil well 12 through casing 14. As will be appreciated, lower section 18 may include multiple segments of oil delivery tubing and as conventional, may include other components such as separators and the like.

Apparatus 10 is then connected to the upper end of lower section 18. Specifically, this is accomplished by threadably coupling lower portion 52 of holder 24 with the upper end of tube segment 56.

Next, additional segments of oil delivery tubing are connected in succession to the upper end of holder 24. In particular, tubing segment 44 is threadably coupled with upper member 38 of holder 24 and successive tubing segments coupled in sequence to form upper section 16.

After about ten lengths or segments (about 300 feet) of oil delivery tubing has been assembled, upper section 16 is tested for integrity by filling with water under pressure to check for leaks. In the preferred embodiment, an hydraulic pump pressurizes the assembled segments of upper section 16 with water at a test pressure of about 500 psi. Rupture disc 22 seals the lower end of upper section 16 during the test. This procedure is repeated after each addition of ten segments of tubing until oil pump 20 is at the desired depth. If a leak is detected during any of the integrity tests, at most ten lengths of tubing will have to be removed and reassembled in order to correct the leak. With the integrity test of the present invention, the integrity of upper section 16 is established thereby assuring pumping efficiency and insuring against the expense of removing and reassembling the pipe string.

When oil pump 20 is at the desired depth, upper section 16 is then pressurized with a burst pressure of about 2000 psi. That is, the hydraulic pressure in upper section 16 is increased until rupture disc 22 bursts at about 2000 psi. When this occurs, rupture segment 34 separates at score line 30 and rotates about hinge area 32 as represented in FIG. 5. The force of the burst is sufficient to cause rupture segment 34 to conform substantially to the interior surface of upper portion 50 of holder 24. This completely opens passage 58 through holder 24 for unrestricted fluid flow.

With passage 58 open, push-pull rod 60 can be inserted through the pipe string and through holder 24 and connected to oil pump 20. Conventional operation of oil well 12 can then occur.

Those skilled in the art will appreciate that the present invention encompasses many variations in the preferred embodiment described herein. For example, rupture disc 22 can be composed of a wide variety of materials known as being suitable for rupture discs. Also, the burst pressure of rupture disc can be specified as needed for particular applications. Additionally, other configurations of the holder can also be developed suitable for particular applications. Having thus described the preferred embodiment of the present invention, the following is claimed as new and desired to be secured by Letters Patent:

What is claimed is:

1. Apparatus for testing the integrity of oil delivery tubing within an oil well casing comprising:

a tubular holder provided with a passage therethrough and having opposed ends, one of said ends being adapted to be attached to an end of one section of the oil delivery tube; and a rupture disc within said holder in normally closing relationship to said passage, said disc being openable under pressure to allow substantially free flow of liquid there past through said passage;

said disc comprising a circular metal membrane having a peripheral flange portion and a central bulged segment defined by a convex surface and a concave surface on opposite sides of said section, said disc being positioned in the holder in a location with the concave surface thereof in facing relationship to said one end of the section on which the holder is mounted, and wherein said disc is provided with a discontinuous arcuate score line in the central bulged segment thereof, the opposed extremities of the score line being in spaced relationship and defining a hinge area therebetween, said rupture disc being capable of withstanding a hydraulic pressure thereagainst of a first test value and constructed to rupture and open when a second burst pressure substantially higher than said test pressure is applied to the disc.

2. Apparatus as set forth in claim 1, wherein said score line is in the concave surface of the bulged segment.

3. Apparatus as set forth in claim 1, wherein said score line is in proximal relationship to said peripheral flange portion of the disc.

4. Apparatus as set forth in claim 1, wherein said holder includes a tubular inlet, and a tubular outlet releasably connected to the inlet, said tubular inlet and tubular outlet cooperating to present said passage through the holder, said rupture disc being positioned between the inlet and the outlet of the holder in spanning and closing relationship to the passage through the holder.

5. Apparatus as set forth in claim 4, wherein said inlet and said outlet have internal cylindrical surfaces which cooperate to define said passage through the holder, the diameter of the passage defined by the internal cylindrical surface of the outlet being greater than the diameter of the passage defined by the internal cylindrical surface of the inlet.

6. Apparatus as set forth in claim 4, wherein the internal cylindrical surfaces of the inlet and outlet cooperatively present a passage having a diameter at least approximately equal to the internal diameter of the oil delivery tube sections.

7. Apparatus as set forth in claim 4, wherein said inlet and outlet are provided with opposed flats thereon for facilitating connection of the holder to said one end section of the oil delivery tube and to components releasably attachable to the outlet of the holder.

8. A method for testing the integrity of multi-segment oil delivery tubing within an oil well casing comprising the steps of:

providing a tubular holder having a passage therethrough, said holder having a rupture disc therein in normal closing relationship to said passage, said disc being openable under pressure to allow substantially free flow of liquid there past through the passage, said rupture disc further being capable of withstanding a hydraulic pressure thereagainst of a first test value, and constructed to rupture and open when a second burst pressure substantially higher than said test pressure is applied to the disc;

attaching said tubular holder with the normally closed disc therein to the end of a multi-segmented section of oil delivery tubing to be lowered into an oil well casing;

lowering the multi-segmented section of oil delivery tubing with the holder thereon into the casing of the oil well with the holder located at the lower end of said section of oil delivery tubing;

discontinuing lowering of the multi-segmented section of oil delivery tubing with the holder thereon when the multi-segmented section of oil delivery tubing has been lowered into the casing to a predetermined extent;

introducing sufficient liquid into said multi-segmented section of oil delivery tubing to cause the section to be filled with liquid at least to a level of the joinder of adjacent tubing sections to be tested for liquid leakage integrity, said rupture disc being capable of withstanding the pressure thereon of the liquid introduced into said multi-segmented section of oil delivery tubing to provide information as to whether the multi-segmented section of oil delivery tube is essentially leakproof;

and thereafter applying sufficient liquid pressure to the rupture disc assembly to effect rupture of the disc when it is desired to open the passage for pumping of oil from the oil well through the tubing.

9. A method as set forth in claim 8, wherein is included the steps of attaching another multi-segmented section of oil delivery tubing to the multi-segmented section of oil delivery tubing having the holder attached thereto, further lowering the segmented oil delivery tubing into the casing of the oil well, introducing additional liquid into the segmented oil delivery tubing to cause the combined multi-segmented oil delivery tubing sections to be filled with liquid at least to a level of the joinder of adjacent additional tubing sections to be tested for liquid leakage integrity, said rupture disc being capable of withstanding the pressure thereon of the additional liquid introduced into said multi-segmented sections of oil delivery tubing to provide added information as to whether the segmented section of oil delivery tubing are essentially leakproof.

10. A method as set forth in claim 9, wherein said steps of adding multi-segmented oil delivery tubing sections to the length of the delivery tubing, and adding further amounts of liquid thereto to test for the integrity of the joinders of adjacent tubing sections is continued until the holder with the rupture disc therein is at a level where oil is to be pumped from the oil well through the delivery tubing.

11. A method as set forth in claim 10, wherein is included the step of applying intermediate level pressure to the liquid contained in the segmented oil delivery tubing sections at a level below the burst pressure of the rupture disc, but above the pressure exerted on the rupture disc by the weight of the liquid contained in the segmented oil delivery tubing sections to effect a final test of the integrity of the joints between segments of the oil delivery tube sections.

12. A method as set forth in claim 10, wherein is included the step of applying an intermediate liquid pressure of at least about 500 psi to the liquid contained in the segmented oil delivery tubing sections.

13. A method as set forth in claim 10, wherein is included a step of applying a final liquid pressure of at least about 2,000 psi to the liquid contained in the segmented oil delivery tubing sections and sufficient to effect rupture of the rupture disc.

14. Apparatus for testing the integrity of multiple section oil delivery tubing forming a pipe string within an oil well casing, said apparatus comprising:

a tubular holder provided with a passage therethrough and having opposed ends, one of said ends being adapted to be attached to an end of one section of the pipe string; and a rupture disc within said holder in normally closing relationship to said passage, said disc being openable under pressure to allow substantially free flow of liquid there past through said passage, said disc comprising a circular metal membrane having a peripheral flange portion and a central bulged segment defined by a convex surface and a concave surface on opposite sides thereof, said disc being positioned in the holder in a location with the concave surface thereof in facing relationship to said one end of the section on which the holder is mounted, the rupture disc being capable of withstanding a hydraulic pressure thereagainst of a first test pressure applied to the concave surface of the disc to verify that the sections of the pipe above the holder do not leak, and wherein said rupture disc is provided with score line defining means for causing the bulged area of the disc to rupture and fully open when a predetermined second burst pressure substantially higher than said test pressure is applied to the concave surface of the disc to thereafter permit use of the pipe string to deliver oil from the well casing without removal of the holder and ruptured disc.

* * * * *